US005458932A

United States Patent [19]

Zinbarg et al.

[11] Patent Number: 5,458,932

[45] Date of Patent: Oct. 17, 1995

[54] SANTA CLAUS-LIKE DECORATIVE OBJECT

[76] Inventors: Benson E. Zinbarg, 320 Chestnut Hill Rd., Stamford, Conn. 06903; Norma Amlicke, 32 Weed Hill Ave., Stamford, Conn. 06907

[21] Appl. No.: 891,398

[22] Filed: May 29, 1992

Related U.S. Application Data

[63] Continuation-in-part of Ser. No. 554,967, Jul. 18, 1990, abandoned, Ser. No. 664,023, Mar. 4, 1991, Pat. No. 5,211,996, Ser. No. 664,024, Mar. 4, 1991, abandoned, Ser. No. 749,165, Aug. 23, 1991, Pat. No. 5,195,638, and Ser. No. 749,263, Aug. 23, 1991, abandoned.

[51] Int. Cl.[6] ..... B44C 3/06

[52] U.S. Cl. ..... 428/16; 206/457; 206/575; 428/35.2; 428/542.2; 446/73; 446/268

[58] Field of Search ..... D9/305, 312, 335; 206/457, 575; 428/16, 35.2, 542.2; 446/73, 268

[56] References Cited

U.S. PATENT DOCUMENTS

| | | | |
|---|---|---|---|
| D. 23,399 | 6/1894 | Lee | D9/314 |
| D. 39,516 | 9/1908 | Prugh | D9/305 |
| D. 47,064 | 3/1915 | Adams | D9/305 |
| D. 49,569 | 8/1916 | Burtchaell | D9/314 |
| D. 66,800 | 3/1925 | Lehnert | D9/305 |
| D. 74,183 | 1/1928 | McEldowney | D9/311 X |
| D. 94,174 | 12/1934 | Vogt | D9/306 |
| D. 96,425 | 7/1935 | Spanel | D9/335 |
| D. 125,195 | 2/1941 | Winsick | D9/305 |
| D. 156,059 | 11/1949 | Vivaudou | D9/305 |
| D. 164,442 | 9/1951 | Park | D9/312 |
| D. 169,265 | 4/1953 | Lavezzorio | D9/305 |
| 177,749 | 5/1876 | Redden | 383/36 |
| D. 183,667 | 10/1958 | Treinis | D9/305 |
| D. 186,410 | 10/1959 | Collins | D9/305 |
| D. 187,497 | 3/1960 | Goldie | D9/305 |
| D. 191,284 | 9/1961 | O'Donnell | D9/305 |
| D. 241,819 | 10/1976 | Flecken | D9/306 |
| D. 256,826 | 9/1980 | Phillips | D21/237 |
| D. 258,205 | 2/1981 | Knoll | D9/305 |
| D. 293,959 | 1/1988 | Allen | D99/39 |
| D. 310,023 | 8/1990 | Dembiczak et al. | D9/305 |
| D. 317,254 | 6/1991 | Dembiczak et al. | D9/305 |
| D. 334,340 | 3/1993 | Parrish et al. | D9/312 X |
| D. 337,265 | 7/1993 | Reed et al. | D9/305 X |
| D. 340,859 | 11/1993 | Reed et al. | D9/305 X |

(List continued on next page.)

FOREIGN PATENT DOCUMENTS

| | | |
|---|---|---|
| 39851 | 5/1907 | Switzerland . |
| 379876 | 9/1932 | United Kingdom . |

OTHER PUBLICATIONS

Dennisons Party Magazine Oct.–Nov. 1927 p. 19 21 37.

Holiday A. Handbook of Elementary Classroom Ideas to Motivate Teaching . . . by Mary E. Platts, 1978.

Creative Ideas for Christmas 1985 Oxmoor House, Inc. pp. 58–59.

Holiday Gifts, Favors and Decorations Lothrop Lee & Shepard Co. 1971 pp. 77–79, 82, 83 & 91.

*Primary Examiner*—Henry F. Epstein
*Attorney, Agent, or Firm*—David P. Gordon

[57] ABSTRACT

Decorative combination structures are disclosed comprising a combination of flexible bag members which together simulate a conception of the appearance of a Santa. The combination structure comprises two flexible bags arranged for receiving filling material therein and for assuming a substantially rounded shape when so filled, with one of the bag assemblies being provided with facial indicia of a Santa and arranged at the top of the stack and other bag assembly having indicia simulating a buckled belt and a pair of mittened hands extending from sleeves with furry cuffs. An additional elongate flexible bag is provided to simulate a tasseled stocking cap and a flexible sheet is provided in the form of a beard. In addition, a plurality of closure or bunching means for the flexible bags are provided, as are a plurality of fastener means for fastening the bags together and to the ground or platform.

20 Claims, 8 Drawing Sheets

U.S. PATENT DOCUMENTS

| | | | |
|---|---|---|---|
| 492,071 | 2/1893 | Vaughan | 383/71 |
| 514,159 | 2/1894 | Nelson | 206/457 |
| 764,207 | 7/1904 | Robinson | 428/17 X |
| 795,630 | 7/1905 | Lynn | 52/82 |
| 824,071 | 6/1906 | Faber et al. | 446/220 |
| 850,672 | 4/1907 | Novak | 52/4 |
| 1,106,353 | 8/1914 | Ademec | 52/4 |
| 1,207,533 | 12/1916 | Gamble | 383/18 X |
| 1,237,930 | 8/1917 | Malvern et al. | 383/6 |
| 1,287,154 | 12/1918 | Wells | 446/372 |
| 1,308,432 | 7/1919 | Lochridge | 446/369 |
| 1,536,816 | 5/1925 | Sale | 446/27 |
| 1,600,749 | 9/1926 | Barnes | 52/4 X |
| 1,649,770 | 11/1927 | Miller | 446/220 |
| 1,698,653 | 1/1929 | Poole | 446/72 |
| 1,950,539 | 3/1934 | Brownfield | 383/70 |
| 1,965,040 | 7/1934 | Kelly | 209/370 |
| 2,008,552 | 7/1935 | Jacobs | 446/221 |
| 2,009,511 | 7/1935 | Nydegger | 229/87.01 |
| 2,112,477 | 3/1938 | Brownfield | 229/74 X |
| 2,208,445 | 7/1940 | Bates | 428/9 |
| 2,460,963 | 2/1949 | Young | 24/30.5 R |
| 2,682,903 | 7/1954 | Gay | 383/80 X |
| 2,689,424 | 9/1954 | Clagett | 40/324 |
| 3,163,418 | 12/1964 | Myers | 273/408 |
| 3,195,265 | 7/1965 | Marquez et al. | 446/73 |
| 3,308,936 | 3/1967 | Roland et al. | 383/80 X |
| 3,349,991 | 10/1967 | Kessler | 383/120 |
| 3,442,043 | 5/1969 | Panzer | 446/109 |
| 3,626,634 | 12/1971 | Jones et al. | 446/122 |
| 3,650,298 | 3/1972 | Delmar | 138/103 |
| 3,670,440 | 6/1972 | Yost | 40/215 |
| 3,835,308 | 9/1974 | Reese | 428/16 X |
| 4,197,983 | 4/1980 | Raudys et al. | 383/24 |
| 4,378,654 | 4/1983 | Wilson | 428/16 X |
| 4,436,204 | 3/1984 | Sowinski | 206/525 |
| 4,445,230 | 4/1984 | Spadaro | 383/7 |
| 4,746,226 | 5/1988 | von Schuckmann | 383/71 |
| 4,795,033 | 1/1989 | Duffy | 206/457 |
| 5,027,457 | 7/1991 | Sweet | 428/16 X |
| 5,115,916 | 5/1992 | Beasley et al. | 206/581 |
| 5,195,638 | 3/1993 | Zinbarg | 206/457 |
| 5,211,996 | 5/1993 | Zinbarg | 206/457 X |
| 5,222,802 | 6/1993 | Beck | 362/156 |

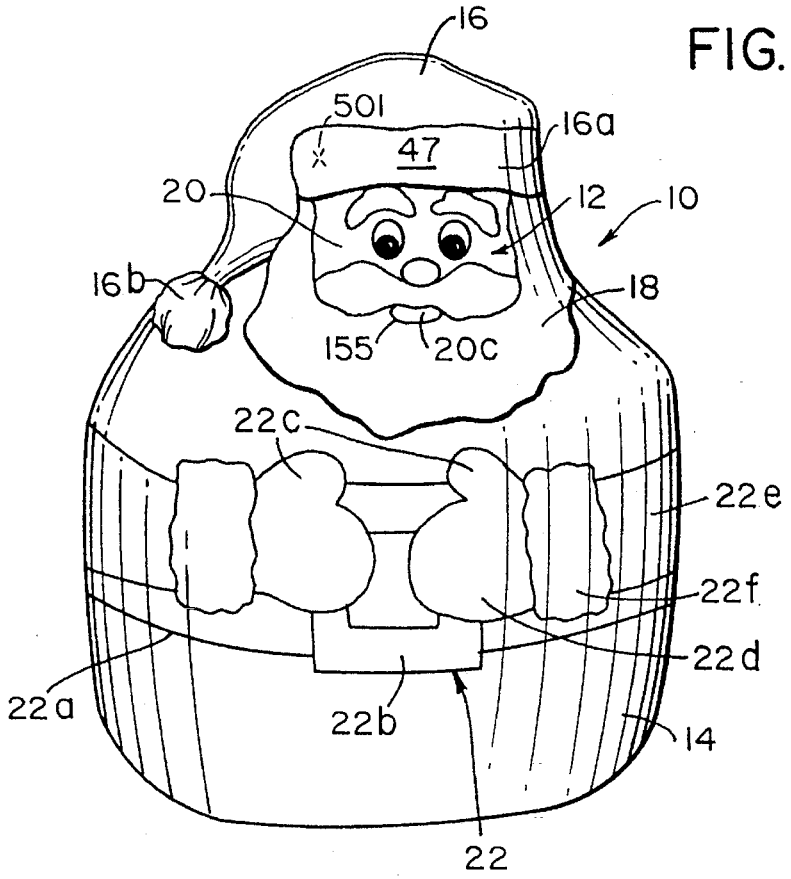
FIG. 1
FIG. 4(A)
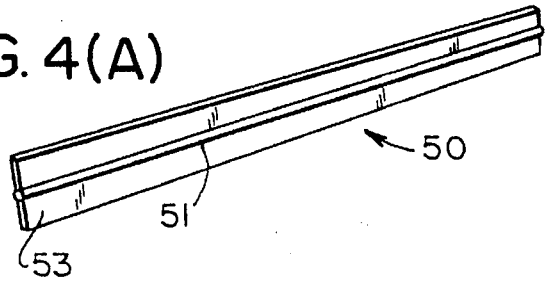
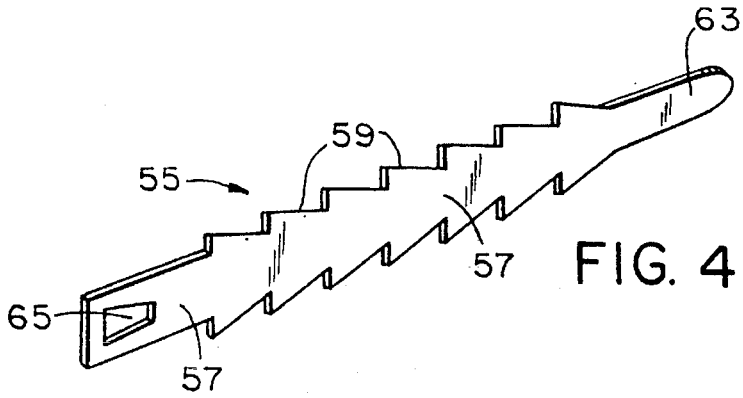
FIG. 4(B)

FIG. 6
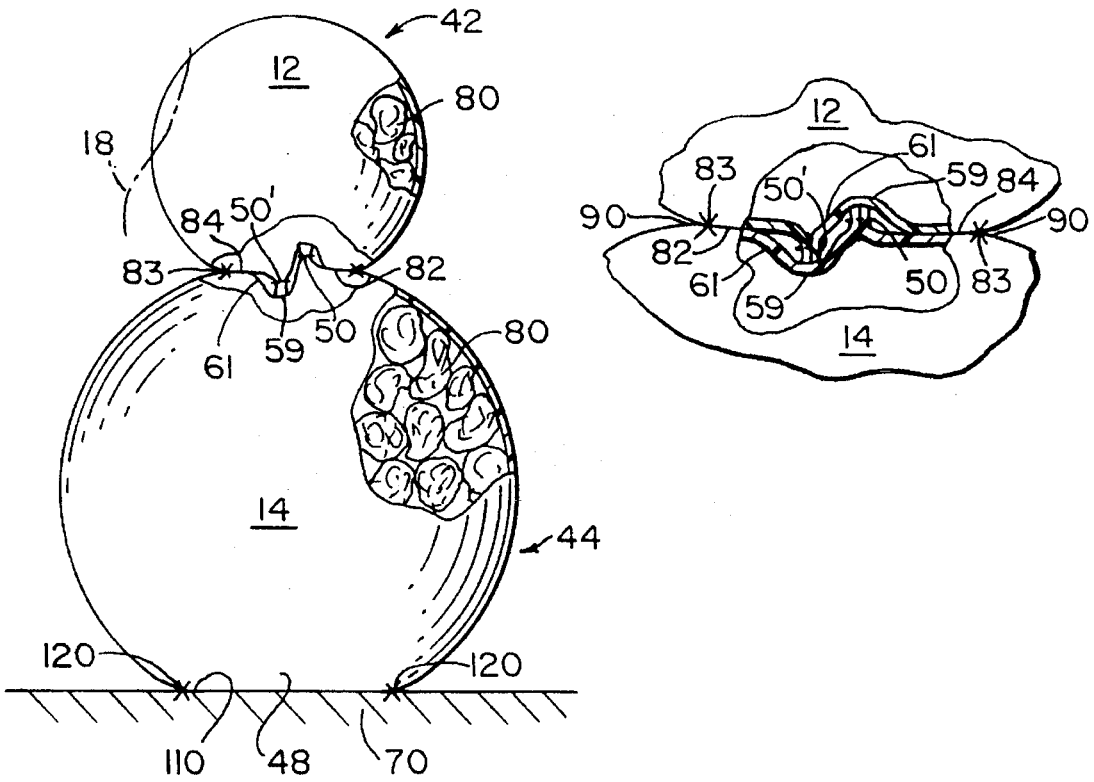
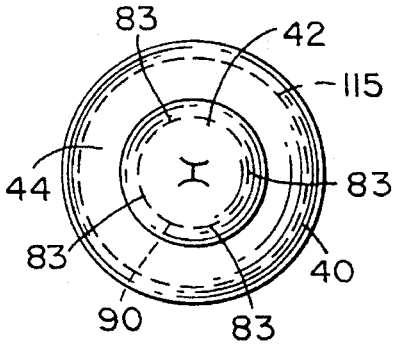
FIG. 6(A)

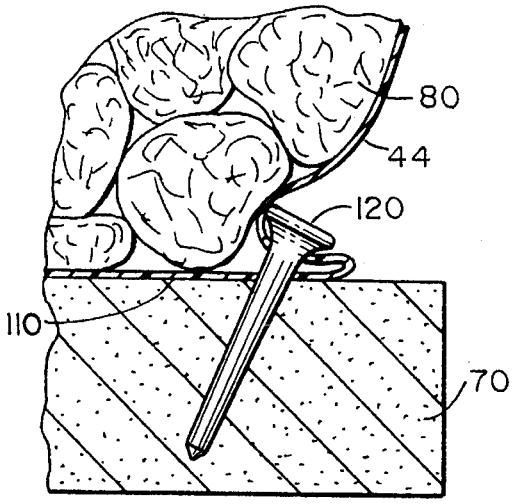
FIG. 8(A)
FIG. 8(B)
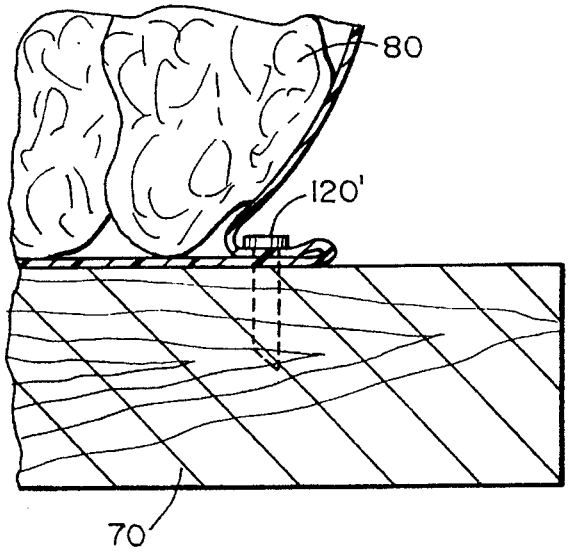
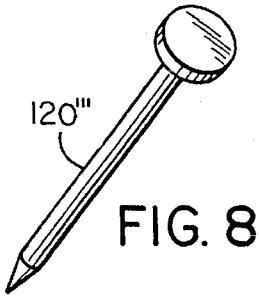
FIG. 8(D)
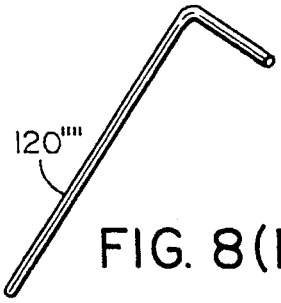
FIG. 8(E)
FIG. 8(C)
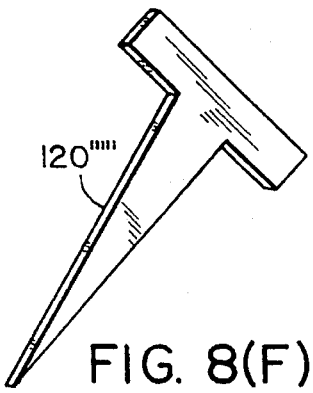
FIG. 8(F)
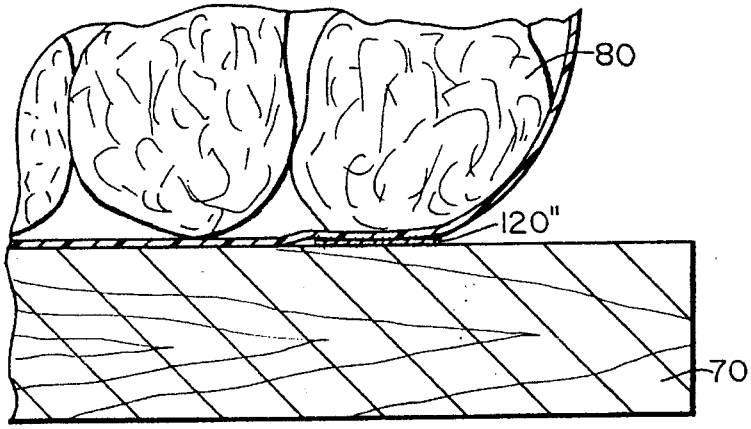

SANTA CLAUS-LIKE DECORATIVE OBJECT

This is a continuation in part of Ser. No. 07/554,967, filed Jul. 18, 1990, now abandoned; Ser. No. 07/664,023, filed Mar. 4, 1991, now issued as U.S. Pat. No. 5,211,996; Ser. No. 07/664,024, filed Mar. 4, 1991, now abandoned; Ser. No. 07/749,165, filed Aug. 23, 1991, now issued as U.S. Pat. No. 5,195,638; and Ser. No. 07/749,263, filed Aug. 23, 1991, now abandoned, which are hereby incorporated by reference herein in their entireties.

BACKGROUND OF THE INVENTION

This invention relates to a combination of stuffable objects. More particularly, the invention relates to a combination of flexible bags which are arranged for receiving filler material, and which, when so filled, decoratively simulate or otherwise represent a common fanciful image or conception of the appearance of a Santa Claus.

At certain times of the year, such as during late fall or winter, Santa-like decorative objects are very popular. These objects are strongly associated with the season even if snowfall does not occur locally. Also, at a certain time of the year, for example in the fall season, in certain geographic vicinities, many leaves are on the ground and home owners often rake their leaves and dispose of them in relatively large leaf bags. Except for a relatively new type of leaf bag (the details of which are disclosed in the parent application hereto, Ser. No. 07/554,967) which has recently been sold during the Halloween season to represent or simulate a pumpkin, the known leaf bags are ordinary leaf bags with no particular significance and with no particular decorative value. In addition, except for the bags disclosed in the parent applications hereto, garbage or refuse bags are typically not decorative or theme-related, and the stuffing of such bags with paper or the like for decorative purposes during holiday seasons has been unknown.

SUMMARY OF THE INVENTION

It is therefore an object of the present invention to provide a combination of objects including large flexible plastic bags, such as leaf-type bags, which when filled with compressible filler material such as leaves, crumpled sheets of newspaper, or the like, and provided with appropriate indicia, simulates a common perception of Santa.

A further object of the present invention is to provide a simple, easy-to-manufacture, easy-to-assemble combination of objects for decorative use either indoors or outdoors which simulate a Santa.

In accordance with the objects of the present invention a decorative combination is provided of three bags representing respectively the base, head and cap portions of a Santa, and a flexible sheet representing a Santa's beard. Each of the three bags comprises a bag member formed of flexible waterproof material and preferably having a pre-sealed end and an initially open opposite end, with the initially open end for receiving a filling material therein such as crumpled sheets or scraps of paper, leaves, or other refuse. The pre-sealed ends of the base and head bags are arranged such that they assume generally rounded shapes when the bag members are substantially filled with filler material. A bunching means is provided for bunching together and closing the initially open ends to form bunched, closed rounded ends after the filling material is inserted in the bag members. In this manner, base and head bag assemblies having a substantially rounded generally spherical shape are provided. The cap bag is elongate and is sized such that its open end fits closely over the top of a filled head bag and its sealed end is bunched and tied to represent a ball type tassel. The cap bag is only loosely filled or remains empty, so that it is flexible and can be draped over the head bag and the upper part of the base bag. The flexible sheet is cut to a shape representing a Santa's beard and sized to cover a lower portion of the head bag and an upper portion of the base bag.

The respective bags are preferably made of thin flexible plastic material such as the material from which plastic leaf or garbage bags are made, and at least the major portion of the outside surface of each bag in the assembly is red. The flexible is sheet provided with appropriate coloration and indicia. The base bag is preferably mostly bright red at its outer surface and simulates the body portion of a Santa and is provided with indicia representing a black belt with a large white buckle and a pair of gloved forearms with thumbs hitched on the buckle. The head bag is preferably light pink or other flesh color of a fanciful Santa's face and is preferably provided with indicia representing a fanciful Santa's face with bushy white eyebrows and cherry red nose and lips. The third of the bags is preferably substantially all bright red, with white peripheral end portions, to simulate a tasseled, stocking type cap when one end is fitted over the top of a filled head bag, and the other end twisted into a ball and tied at the white peripheral portion to simulate a white, ball tassel. The white flexible sheet is provided with indicia representing a Santa's beard and the indicia are cut from the sheet and positioned to cover a lower portion of the facial indicia.

In assembly, the base and head bags are substantially filled with solid compressible particulate filler material, e.g. one or more of leaves, crumpled sheets of paper, paper scraps, etc. The bags are then closed and stacked in a vertical array and clipped or fastened together to provide a decorative simulation of a Santa's body and head which can be erected outdoors and supported on the ground, or indoors, supported on a floor or platform. The elongate cap bag is fitted over the filled head bag at its open end and draped over the head bag. The sealed end of the elongate cap bag is twisted and tied to simulate a tassel. The flexible simulated beard is affixed to the lower portion of the facial indicia of the head bag.

In a particular embodiment of the invention, means are provided for fully stabilizing the combination of bags and flexible sheet. In another embodiment, a kit is provided from which the decorative combination of the present invention can be completely assembled to simulate a Santa.

Additional objects and advantages of the invention will become apparent to those skilled in the art upon reference to the detailed description in conjunction with the accompanying drawings.

BRIEF DESCRIPTION OF THE DRAWINGS

FIG. 1 is a perspective view showing an embodiment of the decorative combination of the present invention simulating a santa;

FIGS. 4(A)–4(B) show closure means for use in the present invention;

FIGS. 5(A), 5(A)-1, 5(B), 5(B)-1, 5(C), and 5(D) show bag member components of the combination of FIG. 1 prior to being filled;

FIGS. 6 and 6(A) show details of the assembly of the combination of the present invention;

FIGS. 8(A)–8(F) illustrates a means for securing of the combination of the present invention to the ground or a platform.

DETAILED DESCRIPTION OF INVENTION

Figure 2A:
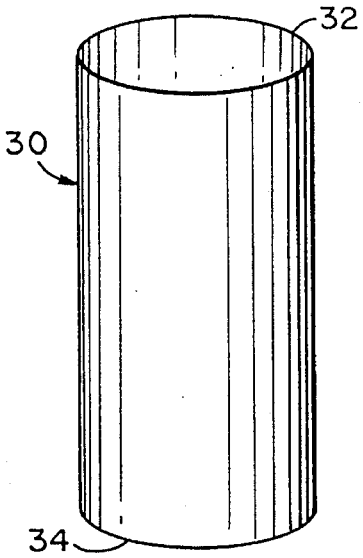
FIGS. 2(A)–2(F) are perspective views of flexible bags that can be used in forming a decorative combination of the present invention.

With reference to FIGS. 1 and 3(A)–3(D), a decorative combination simulating a traditional Santa Claus is indicated at 10, and comprises three bags 12, 14, 16 and a simulated beard member 18. The head bag member 12 is provided with fanciful facial indicia 20, while the base bag 14 is provided at 22 with indicia representing a large black belt 22*a* with a large white buckle 22*b* with red mittened thumbs 22*c* hitched in the buckle 22*b* on the hands 22*d* extending from red sleeves 22*e* with furry white cuffs 22*f*. The elongate cap bag assembly 16 is shown with a plain outer surface which is red. Each bag 12, 14, 16 can be made from any of numerous flexible bags, examples of which are shown in FIGS. 2 (A)–(E).

Figure 2B:
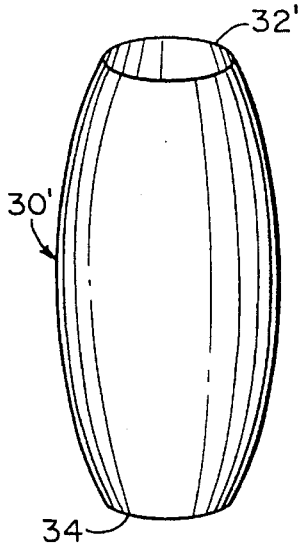
Figure 2C:
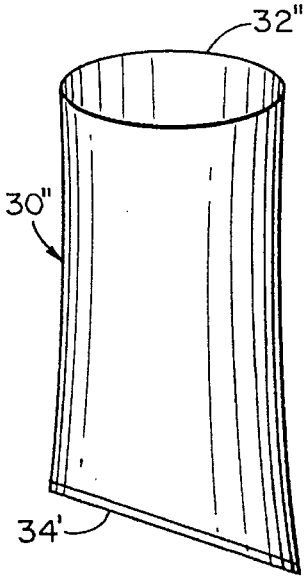
Figure 2D:
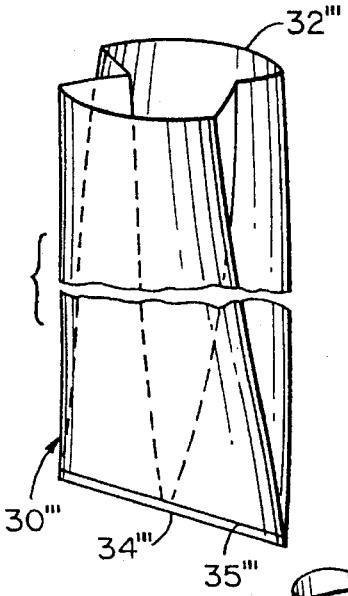

FIG. 2(A) show a tubular bag 30 formed in a substantially cylindrical shape from a flexible, typically waterproof plastic material, for example, of the type conventionally used for trash or leaf bags and suitable for indoor and outdoor use. Alternatively, the bag material can be any other type of plastic film-type material, paper woven or non-woven fabric or any other suitable thin, flexible, film-type material. Although bag 30 is shown having a cylindrical tubular configuration with first and second ends 32 and 34, the bag may have any other suitable configuration within the scope of the present invention. For example, a convex cylindrical configuration bag 30' is shown in FIG. 2(B). Bag 30' has first and second ends 32' and 34'. Alternatively, and as shown in FIG. 2(C), a conventionally shaped leaf or trash bag 30" having an open end 32" and a closed bottom end 34" can be used. As shown in FIG. 2(C), the closed bottom end 34" is closed by heat sealing. As a still further alternative, a conventional gussetted bag 30'" as shown in FIG. 2(D) can be used. Gussetted bag 30'" has a closed bottom end 34'" and an open top end 32'". With the gussetted bag 30'", the opposed bottom sides of the bag are each drawn inwardly into the bag and secured to the overlapping bottom portion to form gussets in a conventional manner, as shown at 35'". In any case, bag 30 has an upper open end 32 and a lower end 34 which may be open as shown in FIGS. 2(A) and 2(B) or which may be closed as shown in FIGS. 2(C) and 2(D).

Figure 2E:
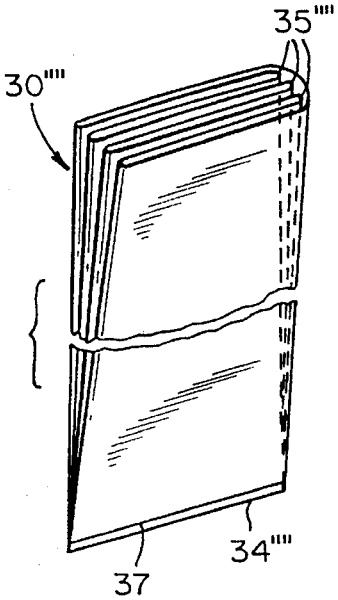

As shown in FIG. 2(E), when using a bag 30"" having a closed bottom end 34"" with a so-called Z-lock, construction of the lower portion of the bag provides a limited bunching effect of the bottom end of the bag when it is filled. A "Z-lock" bag is a commercially available bag and can be considered as a modified gussetted bag. Specifically, with a Z-lock bag, as shown in FIG. 2(E), gussets 35"" are formed along the length of the Z-lock bag, preferably with the innermost portions of the side gussets 35"" meeting around the middle of the bag. Then, the bag is folded in half over itself, and secured in such position by heat sealing or the like to provide a heat seal 37 at the bottom 34"" of the bag. The securing of the bag in such a position can be made by a conventional heat seal 37 or the like along the bottom of the bag. In this sense, bottom end 34"" of bag 30"" is provided with a limited bunching effect.

Figure 3:
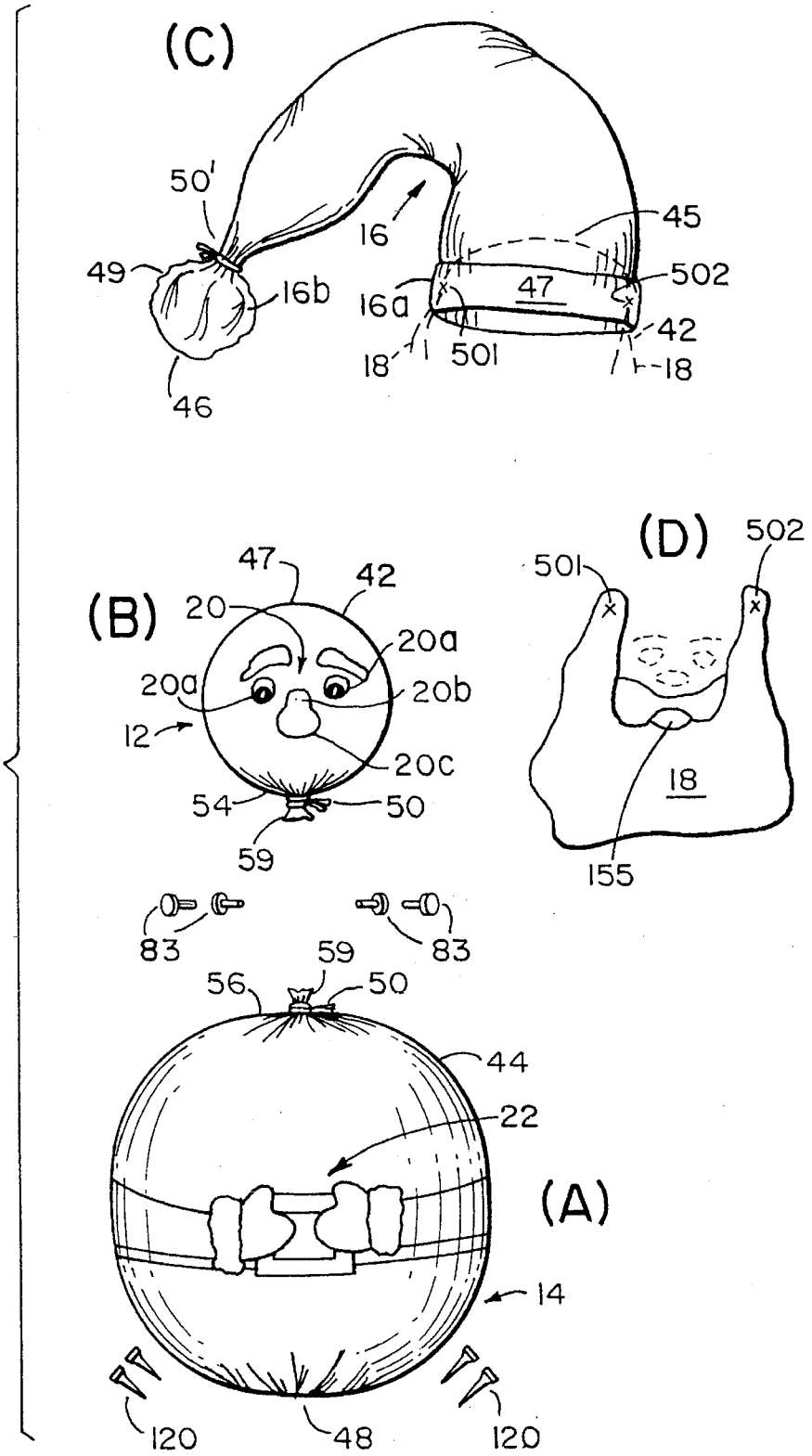
FIGS. 3(A)–3(D) together provide an exploded view showing the components of the combination of FIG. 1 in separated form.

In accordance with one aspect of the present invention, bags 30–30"", when assembled and filled, according to the present invention, assumes a substantially rounded configuration, as shown at 42, 44 in FIGS. 3(A)–(B). This is accomplished as follows. First, one end (34) of three selected bags 30–30"" of FIGS. 2(A)–(E) unless already pre-sealed, are sealed by any suitable means, e.g., heat sealing, or twist-tie means, etc., so as to form first closed ends 46, 47, 48. Thereafter, the base and head bags 14 and 12 are filled with compressible material particles, such as leaves, crumpled newspaper, paper scraps, or other lightweight compressible materials, such that bags 12 and 14 assume an almost rounded, generally spherical shape as shown at 42 and 44 in FIGS. 3(A)–(B). The upper open ends 32 of the bags 12 and 14 are then closed in a "bunched" manner by use of closure means such as ties 50 of FIG. 4(A) or flexible barbed straps 65 of FIG. 4(B), or a clamp, a rubber band, or the like, so as to form tied-together or bunched, generally rounded closed ends 54, 56 as shown in FIGS. 3(A)–3(B).

As aforementioned, each of the generally spherical filled bags 12, 14 preferably has indicia on its outer surface to simulate the appearance of a Santa. Thus, facial indicia 20, can be provided separately or printed on the top (head) bag 12. For example, eyes 20*a*, nose 20*b*, mouth 20*c* and eyebrows 20*d* can be separately provided to be applied by means of adhesive on the outer surface of bag 12 which in at least its mid-section portion 41 has a coloration suitable to represent the facial complexion of a Santa, e.g., light pink, brown, or otherwise. In such case, the indicia illustrates the traditional fanciful expressions applied to an actual Santa such as a smile or the like, which can be provided for selective use by the user. Suitably, the facial indicia are "self-stick" adhesive backed members for easy application. Alternatively, such facial indicia 20 can be preprinted on the outer surface of the top bag 12. Likewise, the aforedescribed indicia 22 on the base bag member 14 can be provided in a preprinted manner or applied as self-stick adhesive backed members.

The third bag 16 of the Santa combination 10, is suitably colored bright red as indicated at 45, except at its peripheral end portions 47, 49 which are colored white. End portion 47 forms the brim of a red stocking cap and the third bag 16 has a diameter such that the end portion 47 can snuggly fit over the top of bag 12. The end portion 49 of the third bag 16 is bunched and tied at 50' to form a round tassel 16*b*. Typically, in use, the third bag 16 is not filled with filler material.

Figure 5A:
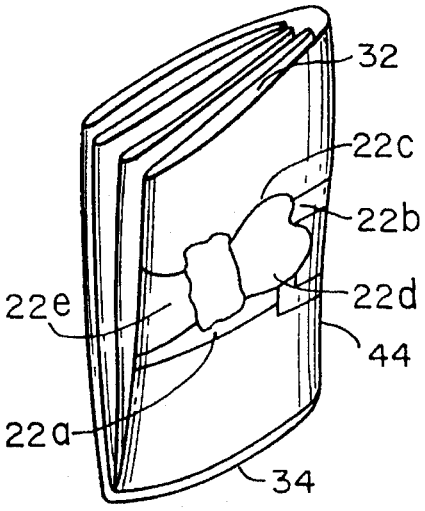
Figures 1, 5A:
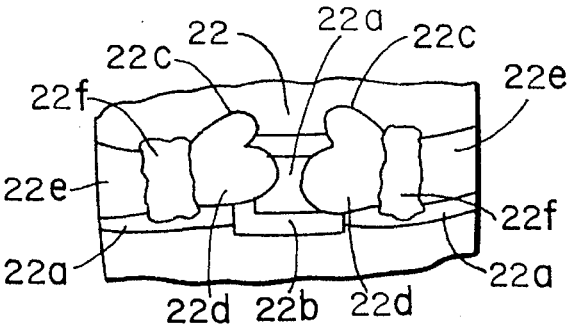
Figure 5B:
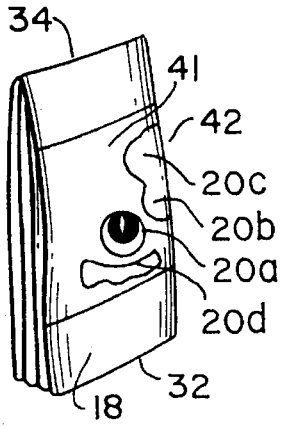
Figures 1, 5B:
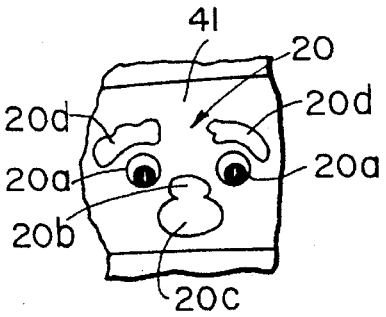
Figure 5C:
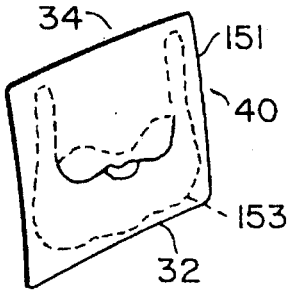
Figure 5D:
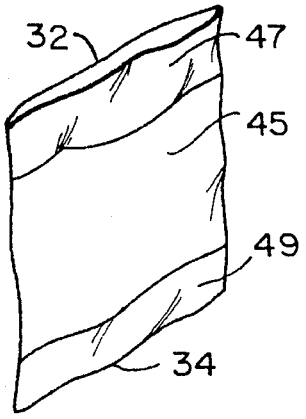

As seen in FIGS. 3(C) and 5(C), a flexible sheet 151 is provided with markings 153 forming the outline of a beard. When cut from sheet 151, the Santa's beard 18 has an opening at 155 to expose the red lips 20*c* of the facial indicia 20. The beard 18 is attached to one or more of bags 12, 14, and 16 as described hereinafter.

In the decorative combination of the present invention, outdoor-type bags are preferred as part of the bag assemblies, with a large sized bag being preferred for the base bag assembly 14 and a smaller size being used for the bag assembly 12 and a more narrow and longer size for bag assembly 16. By way of example, and not by way of limitation, the base bag might be about forty-eight inches tall and forty-four inches in diameter with the belt buckle indicia aout eighteen inches from the sealed bottom end; the top bag might be about twenty-four inches tall and twenty inches in diameter with the facial indicia being about twelve inches in length and starting about five inches from the bottom sealed end; and the elongate cap bag might be about thirty-four inches tall and eighteen inches in diameter with the white peripheral end portions each being about four to six inches wide. The beard member, by way of example and not by way of limitation may be about fifteen inches by fifteen inches and can be cut from a sheet 151 which is at least that size.

As discussed above, bunching (closure) means are desirable for closing the stuffed bags 12 and 14. On such bunching means is a conventional tie 50, noted above and shown in FIG. 4(A) which comprises a flexible wire 51 embedded in flexible plastic 53. An alternate bunching means is shown at 55 in FIG. 4(B) formed of flexible plastic strap 57 with barbs 59 which engage the strap when the tapered end thereof 63 is threaded through opening 65. This type of bunching means is commercially available. These illustrations are shown only by way of example, and other ties or bunching means can be used.

Figure 2F:
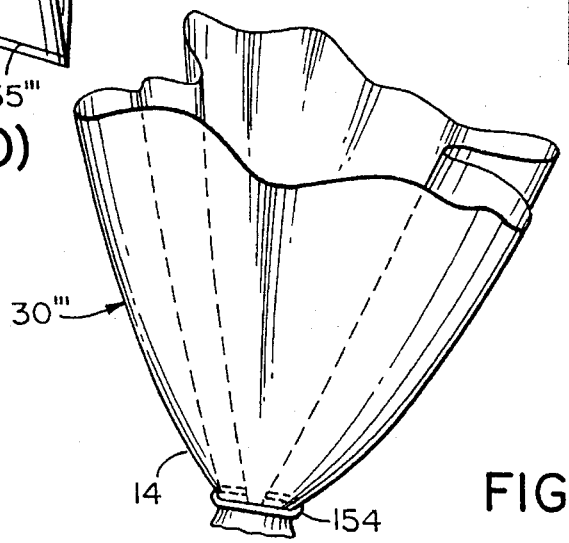

As another alternative, when using the gussetted bag 30''' of FIG. 2(D), a springy or bendable C-clip 154 can be used, as shown in FIG. 2(F). In such case, the opposite ends of C-clip 154 enter the side gussets of bag 30''' and pull the gussets toward each other so as to effectively bunch together bottom end 34''' of bag 30'''.

It will be appreciated that any suitable dimensions and materials can be used with bags 30–30''''. However, in a typical embodiment, it is preferred that all of the bags be made of polyethylene or a similar waterproof material having a thickness in the range of about 0.5–5 mils, with a preferred thickness of about 1.3 mils.

The combined decorative structure of the present invention is assembled preferably with reference to FIGS. 6 and 6(A). Bags 12 and 14 are preferably filled to forms 42, 44 and are closed with ties or other bunching or closure means as hereinabove described. The filled bags are then stacked in a vertical array as shown in FIG. 6 with the base bag member 44 being placed on the ground or platform 70 with its pre-sealed end 48 adjacent thereto as shown. The head or top bag member 42 is positioned on top of the base bag member 44 in vertical alignment therewith with its closure member 50' closely adjacent to the closure member 50 of the base bag member 44. Of course, if desired, the top bag member and/or the base bag member can be turned upside down if indicia are not preprinted on the bags.

Figure 7A:
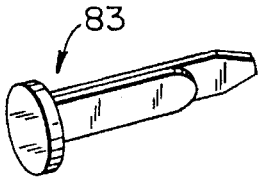
FIGS. 7 (A)–7(E) illustrate details for securing of the components of the combination of the present invention.
Figure 7B:
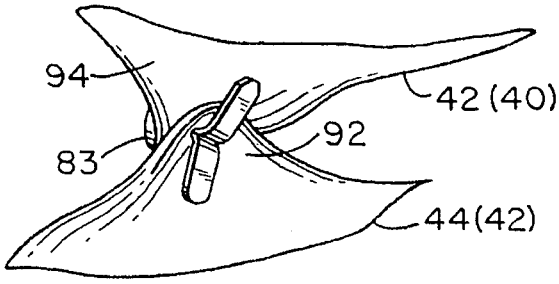
Figure 7C:
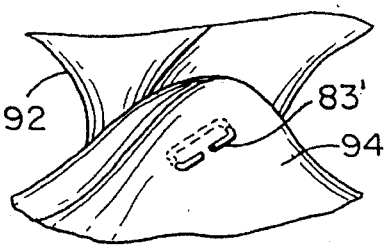
Figure 7D:
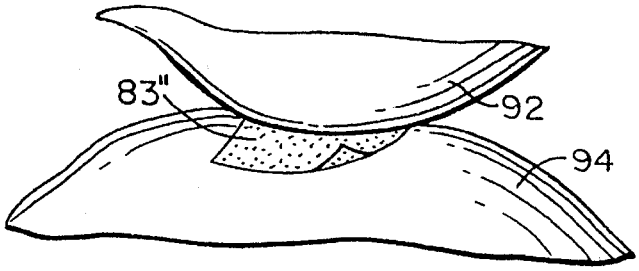
Figure 7E:
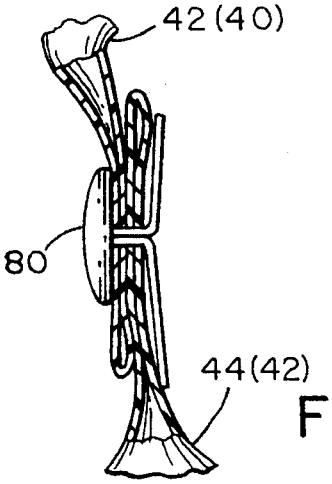

The filled top bag member 42 and filled base bag member 44 are arranged so that their respective indicia 20, 22 (seen in FIGS. 1, 3(A) and 3(B)) are generally in vertical alignment and simultaneously visibly when viewed in the same direction, i.e. line-of-sight. Due to the compressibility of filler material 80, e.g. leaves, crumpled newspaper pages and proper scraps and the like, the abutting portions 82, 84 of base and top bag members 44, 42 are readily flattened, e.g. by the weight of the filler or by hand pressure, whereby the contiguous abutting flattened opposed portions, 82, 84 have a generally circular periphery as indicated at 90 of FIG. 6(A). The base bag member 44 and the top bag member 42 are joined together, suitably by one or more spread clips 83, illustrated in FIG. 7(A), 7(B), and 7(E), or by a staple 83' as shown in FIG. 7(C) or double sided tape shown at 83" in FIG. 7(D), or by other suitable means such as, e.g., single-sided tape (not shown). The adjacent bag assemblies 44, 42 can be secured together by pinching together adjacent portions thereof close to the location of periphery 90 of flattened portions 82, 84 and fastening the pinched portions 92, 94 together as shown in FIGS. 7(B), 7(E). The fasteners 83 or 83' are preferably used at a plurality of locations close to and within periphery 90 as shown in FIG. 6(A) Instead of clips 83, 83', double sided tape 83" can be placed at a plurality of peripheral locations and bag-to-bag securing obtained. The periphery 90' of contiguous flattened portions 84' 82' is shown in FIG. 6(A) with fastener means 83 positioned adjacently close to periphery 90.

As shown in FIG. 6, the bunched extensions 59 of each of the filled bag assemblies 42, 44 which extend beyond closure means 50 inwardly deforms the adjacent flattened portion of the adjacent flexible bag. Deformation is permitted as indicated at 61 due to the flexibility of the bag and the compressibility of filler material 80. In this manner, the bunched extensions 59 are hidden from view in the assembled combination thus presenting a completely smooth surfaced object and thereby enhancing the appearance and simulation of a Santa.

To complete the Santa assembly, the stocking cap bag member 16 is affixed to the top bag member 12. The beard member 18 likewise can be fixed top bag member 12 and/or to the cap bag member 16 and/or the base bag member 14. As seen in FIGS. 1 and 3(D), and in accord with a preferred embodiment of the invention, the cap bag member 16 and beard member 18 are both fixed together to the top bag member 12 by the above-described fastening means at locations 501, 502, which are on opposite sides of the facial indicia 20. The fastening means at these attachment locations can be covered by the peripheral end portion 47 of the cap member 16 by folding a portion of the end portion 47 over or under on itself (as shown at **16*a***).

As shown in FIGS. 6, 6(A), 8(A), and 8(B), base bag 44 can be secured to the ground (or platform) 70 at the periphery 115 of the flattened lowermost generally circular portion 110 of the base bag 44 using a plurality of wooden golf tee-type fasteners 120 as shown in FIG. 8(A), heavy duty staples 120' (from a staple gun) when using a wooden platform as shown in FIG. 8(B), or double sided tape 120" as shown in FIG. 8(C). Alternate fasteners for securing the filled base bag 44 to the ground or platform include nails 120''' such as shown in FIG. 8(D); bent wire 120'''' such as shown in FIG. 8(E); and a plastic anchor 120''''' such as seen in FIG. 8(F).

Figure 9:
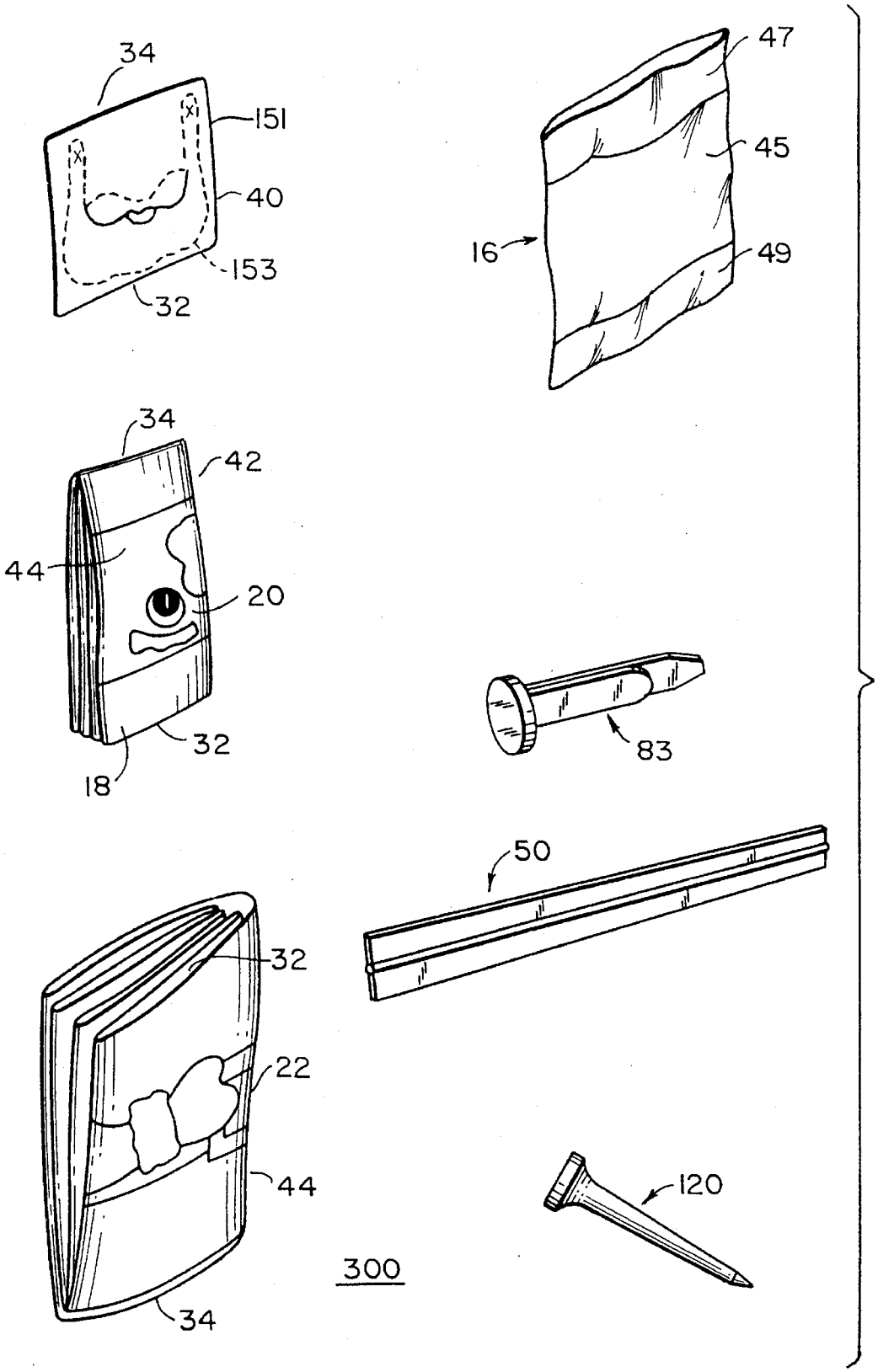
FIG. 9 illustrates a kit for a decorative combination of the present invention.

A kit 300 for the combination of a Santa as shown in FIG. 9 comprises at least three flexible bag members 12, 14, and 16 which are preferably of different sizes as hereinabove described, a plurality of closure or bunching means such as ties 50, a plurality of first fastener means such as spread clips 83, and a plurality of second fastener means such golf tees 120. Preferably, a sheet 151 is also provided with a cut-out indicia or dotted line from which a beard member 153 can be cut. The smaller bag 12 has facial indicia 20 of a Santa, a closed end 34 suitably heat sealed, and an open end 32 which is closed by a bunching means 50 after the bag has been suitably stuffed. The large base bag 14 has indicia 22 representing a buckled belt and mittened hands as above-described extending horizontally away between the open end 32 and closed heat sealed end 34 thereof. Again, the open end 32 is closed by a bunching means 50 after the intermediate sized bag 12 has been suitably stuffed. Bag member 16 preferably includes opposite peripheral borders 47, 49 to provide a brim and tassel as above-described. The bag members 12, 14 which are intended for the base and head of a simulated Santa, are suitably a Z-lock type gussetted bag which are heat sealed at their closed ends 34. The first fastener means such as spread clips 83 are used for attaching the bags 12, 14, and 16 together, and also attaching the beard to one or more of bags 12, 14, and 16, while the second fasteners such as golf tees 120 are used for fastening the largest bag to the ground. The bags 12, 14, 16 are preferably colored red, white and black, with pink and cherry red facial indicia as above-described.

While there has been described and illustrated preferred embodiments of the present invention, it is apparent that numerous alterations, additions and omissions may be made without departing from the spirit and scope of the invention as defined in the claims.

What is claimed is:

1. A decorative bag assembly which simulates a conception of the appearance of a Santa, comprising:

a) a base bag member made of thin waterproof flexible material, said base bag member having at least one open end for receiving a filling material, and having an outer surface which is at least mostly red to simulate a red Santa's coat;

b) a top bag member made of thin waterproof flexible material, said top bag member having at least one open end, and having an outer surface which is at least partially a color other than red to simulate the facial skin of a Santa, said top bag member being substantially smaller than said base bag member and having a first diameter when substantially filled with a filling material;

c) an elongate bag member made of thin flexible material having at least one open end, and having an outer surface which is at least mostly red to simulate a Santa's hat, said elongate bag member having a diameter at said open end substantially similar to said first diameter;

d) a sheet of thin flexible material having an outer surface which is at least mostly white, said sheet of thin flexible material, or at least a portion thereof being adapted for serving as a Santa's beard;

e) at least two individual bunching means for substantially closing the respective open ends of said base and top bag members, wherein said base, and top bag members assume generally spherical shapes after said bag members are substantially filled with said filling material; and f) a plurality of fastening means for fastening said top bag member to said base bag member, and said sheet to one or more of said top bag member, base bag member, and elongate bag member, wherein said base and top bag members when filled with said filling material and closed by said closure means are stackable in a vertical array with the base bag member being placed on the ground, said top bag member being positioned adjacent on top of the base bag member, said elongate bag member being positioned to surround a portion of said top bag member, and at least a portion of said Santa's beard positioned adjacent said top bag member, thereby providing a decorative combination object which simulates a Santa.

2. A decorative bag assembly according to claim 1, wherein:

said base bag member has indicia simulating at least one of a belt with a buckle, mittens or cuffs; and said top bag member has indicia simulating a Santa's face with at least two of a mouth, a nose, eyes or eyebrows.

3. A decorative bag assembly according to claim 2, wherein:

said top and base bag members are arranged so that said indicia simulating at least two of a belt with a buckle, mittens or cuffs, and said indicia simulating a Santa's face are generally in alignment and simultaneously visible.

4. A decorative bag assembly according to claim 3, wherein:

said at least one of a belt with a buckle, mittens or cuffs, comprises all of a belt with a buckle, mittens, and cuffs, and said cuffs are white in color, said belt is black in color, and said buckle is white in color.

5. A decorative bag assembly according to claim 4, wherein:

said top and base bag members each have a presealed end, said top bag member is arranged with its closure means adjacent the closure means of said base bag member, said base bag member is arranged with its presealed end adjacent the ground, and said top bag assembly is arranged with its presealed end distant from said base bag member.

6. A decorative bag assembly according to claim 5, wherein:

respectively adjacent portions of said base bag member and said top bag member when filled with said filler material are substantially flat and form contiguous opposed portions having a substantially circular periphery, said base bag and top bag members being fastened to each other by said plurality of fastening means at locations adjacent said substantially circular periphery.

7. A decorative bag assembly according to claim 6, wherein:

said sheet is substantially rectangular and includes an outline of said Santa's beard marked thereon.

8. A decorative bag assembly according to claim 5, wherein:

the portion of said base bag member adjacent the ground or support is flat and has a generally circular periphery, and said decorative bag assembly further comprises a plurality of securing means for securing the base bag member to the ground or support at the flat portion of the base bag member adjacent the ground or support and adjacent the circular periphery of the flat portion.

9. A decorative bag assembly according to claim 1, wherein:

said top and base bag members each have a presealed end, and said top bag member is arranged with its closure means adjacent the closure means of said base bag member.

10. A decorative bag assembly according to claim 9, wherein:

said base bag member is arranged with its presealed end adjacent the ground, and said top bag assembly is arranged with its presealed end distant from said base bag member.

11. A decorative bag assembly according to claim 1, further comprising:

said at least two individual bunching means comprises three individual bunching means, a third of said three individual bunching means for bunching a peripheral portion of said elongate bag member to form a tassle for said Santa's hat.

12. A decorative bag assembly according to claim 1, wherein:

respectively adjacent portions of said base bag member and said top bag member when filled with said filler material are substantially flat and form contiguous opposed portions having a substantially circular periphery, said base bag and top bag members being fastened to each other by said plurality of fastening means at locations adjacent said substantially circular periphery.

13. A decorative bag assembly according to claim 1, wherein:

said sheet is substantially rectangular and includes an outline of said Santa's beard marked thereon.

14. A decorative bag assembly according to claim 1, wherein:

said base bag member is a bag of at least twenty gallon capacity.

15. A kit for forming a decorative combination structure for simulating a fanciful conception of the appearance of a Santa, comprising:

a white flexible plastic sheet having at least a portion adapted for serving as a Santa's beard;

first and second individual different sized flexible waterproof bags each having an open end for receiving filler material, the smaller of said bags for simulating a Santa's head and adapted to have facial indicia thereon for simulating the appearance of the face of a Santa, and the larger of said bags for simulating a Santa's body and adapted to have indicia thereon for simulating Santa's clothing accessories;

a third individual flexible bag for simulating a Santa's hat, and having spaced apart peripheral end portions for simulating respectively a stocking cap rim and a tassel of said Santa's hat;

individual bunching means for bunching together and closing said open ends of said first and second bags after filling material is inserted in said bags;

a plurality of anchoring means for anchoring the larger of said bags to a surface; and at least one connecting member for connecting said first and second bags to each other.

16. A kit in accordance with claim 15, wherein:

said first and second bags are preprinted with said indicia.

17. A kit in accordance with claim 15, further comprising:

indicia for simulating the appearance of Santa's face, and indicia for simulating the appearance of a belt, a belt buckle, and mittens, wherein said indicia include a sticky surface.

18. A kit in accordance with claim 15, wherein:

said at least one connecting member comprises either a plurality of bendable spread clips or at least one piece of double sided tape, and said plurality of anchoring means includes at least one of a plurality of heavy duty staples, a plurality of golf tees, or a plurality of pieces of double sided tape.

19. A kit in accordance with claim 15, wherein:

said white flexible sheet has cut-out indicia for outlining said Santa's beard.

20. A kit in accordance with claim 15, wherein:

the outside surface of said larger bag member is substantially all red in color, and said larger bag member is a bag of at least twenty gallon size.

* * * * *